US005802421A

United States Patent [19]

Miura

[11] Patent Number: 5,802,421

[45] Date of Patent: Sep. 1, 1998

[54] HEATING AND FIXING DEVICE WITH AC ZERO-CROSS DETECTION CIRCUIT

[75] Inventor: Shigeo Miura, Tokyo, Japan

[73] Assignee: Canon Kabushiki Kaisha, Tokyo, Japan

[21] Appl. No.: 519,743

[22] Filed: Aug. 28, 1995

[30] Foreign Application Priority Data

Aug. 26, 1994 [JP] Japan ..... 6-224013
Aug. 26, 1994 [JP] Japan ..... 6-224014

[51] Int. Cl.[6] ..... G03G 15/20

[52] U.S. Cl. ..... 399/33; 399/69; 219/216

[58] Field of Search ..... 355/282, 285, 355/289, 290; 219/469, 388, 216, 492, 497; 399/33, 69, 88, 329

[56] References Cited

U.S. PATENT DOCUMENTS 4,493,984 1/1985 Yamauchi ..... 219/216 X
4,656,338 4/1987 Yagasaki et al. ..... 219/216 X
5,367,369 11/1994 Nakai et al. ..... 355/285

FOREIGN PATENT DOCUMENTS 63-104068 5/1988 Japan .
4090563 3/1992 Japan .
4282588 10/1992 Japan .

*Primary Examiner*—Robert Beatty
*Attorney, Agent, or Firm*—Fitzpatrick, Cella, Harper & Scinto

[57] ABSTRACT

A heating and fixing device includes a heater for generating heat upon electric power supply thereto; a zero-cross detection device for detecting a zero-cross point of AC power supplied to the heater; electric power supply control device for controlling the electric power supply to the heater, wherein the electric power supply control device phase-controls the electric power supply to the heater in cooperation with the zero-cross detection device: and an abnormality detection device for detecting abnormality of the AC power in accordance with an output of said zero-cross detection device.

2 Claims, 7 Drawing Sheets

HEATING AND FIXING DEVICE WITH AC ZERO-CROSS DETECTION CIRCUIT

FIELD OF THE INVENTION AND RELATED ART

The present invention relates to a heating and fixing device usable with an image forming apparatus such as copying machine, printer, facsimile machine, for example, a heating and fixing device for heating and fixing an unfixed image by a fixing roller containing a heater and a pressing roller, or a heating and fixing device wherein a nip is formed between a heater and a pressing roller, and the unfixed image is heated and fixed through a film sandwiched between the heater and a pressing roller. For a satisfactory image, it is necessary in heating to fix a temperature of the heater at a predetermined temperature. Conventionally, the energization power to t heater is determined in accordance with an output of a temperature detection element for detecting the temperature of the heater or fixing roller or in accordance with an output of power source voltage detection means. As for the switching method, there are known a wave number control wherein an energization wave number of AC power for a unit time is changed, and a phase control wherein a circuit for detecting a zero-cross point of AC power is provided, and a conduction angle of the AC is switched, or the like. However, in the conventional device, a detection means for detecting an abnormality of an AC voltage source to be supplied to the heater is not provided. Therefore, if the ON/OFF of the switch is repeated within a short period by tampering by children, for example, it cannot be detected. Additionally, if a very long term interruption or the like occurs due to a defective contact with the electrical outlet or the trouble with the electric power equipment upstream of the electrical outlet, it cannot be detected.

In such a case, despite the ON OFF of the AC voltage source at the period of several hundreds ms approx., the DC voltage source for the conventional heater control circuit does not stop the supply from the DC voltage source to the heater control circuit unless the interruption continues at least for approx. 3 sec, and therefore, the heater control circuit effects the heater control as in normal AC voltage source state.

When, for example, the heater supplied with AC100V is controlled by a phase control, and when the temperature of the heater is increased from 100° C. to 200° C., the heater control circuit calculates the necessary electric power on the assumption that 100 V is applied, and effects the predetermined phase control. When, however, interruption occurs, the energy applied to the heater is small during that period, and therefore, the temperature of the heater does not reach the target temperature of 200° C.

SUMMARY OF THE INVENTION

Accordingly, it is a principal object of the present invention to provide a heating and fixing device wherein the heater control upon a difference of a normal AC voltage source applied to the heater is optimized, thus preventing the breakdown of the heater.

It is another object of the present invention to provide a heating and fixing device wherein the heater control upon interruption of a AC voltage source due to the abnormality operation is optimized, thus preventing the breakdown of the heater.

According to an aspect of the present invention, there is provided a heating and fixing device comprising: a heater for generating heat upon electric power supply thereto; a zero-cross detection means for detecting a zero-cross point of AC power supplied to said heater; electric power supply control means for controlling the electric power supply to said heater, wherein said electric power supply control means phase-controls the electric power supply to said heater in cooperation with said zero-cross detection means; and abnormality detection means for detecting abnormality of the AC power in accordance with an output of said zero-cross detection means.

According to another aspect of the present invention, there is provided a heating and fixing device comprising: a heater for generating heat upon electric power supply thereto; a voltage detection means for detection of a voltage of the electric power to said heater; control means for controlling the electric power supply to said heater; and abnormality detection means for detecting the abnormality of the electric power on the basis of output of said voltage detection means.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Figure 1:
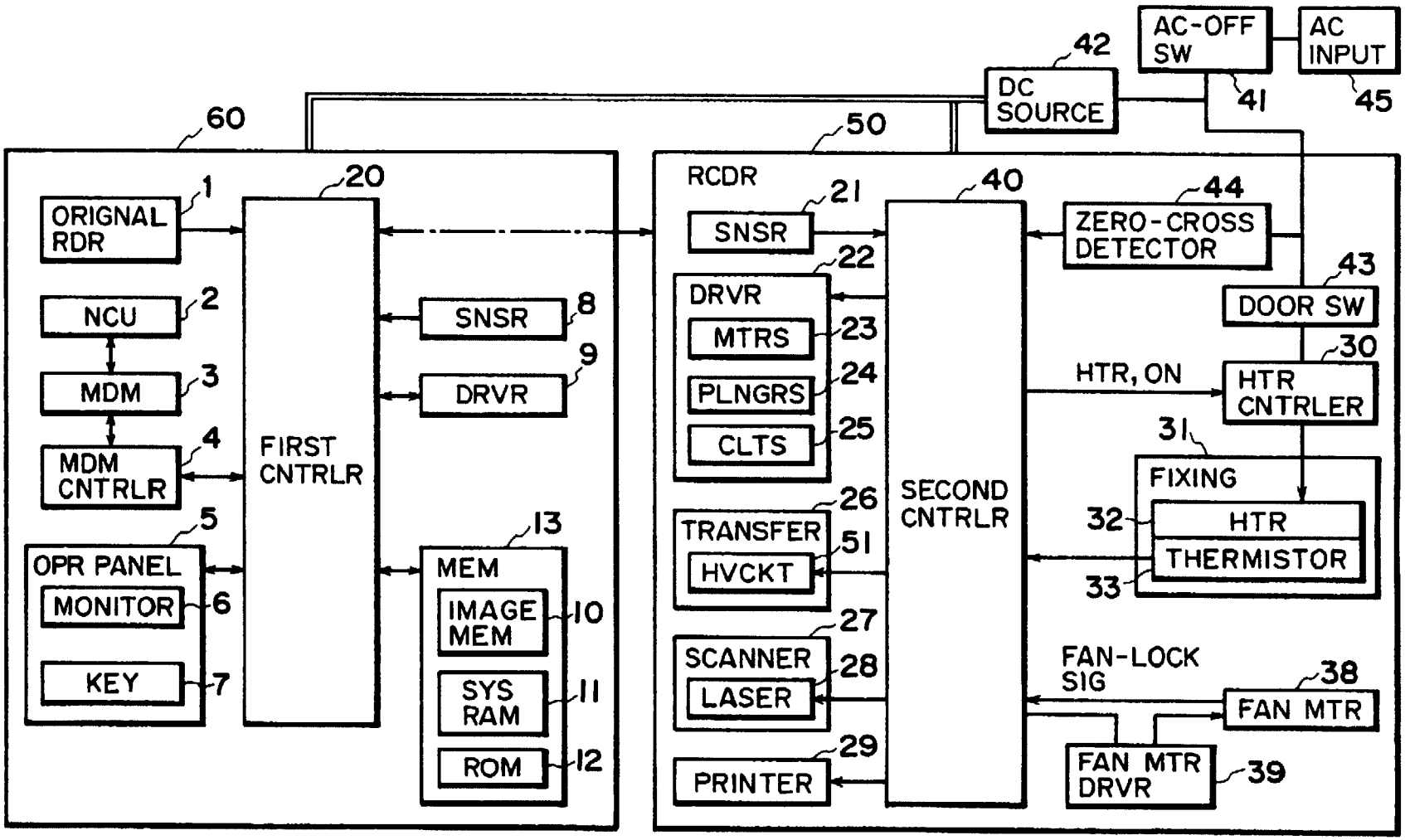
FIG. 1 is a block diagram of a facsimile machine according to a first embodiment of the present invention.

The first embodiment of the present invention will be described in conjunction with FIG. 1 to FIG. 4. FIG. 1 is a block diagram of a facsimile machine having a heating and fixing device according to this embodiment. As shown in FIG. 1, the device of this embodiment comprises a recording station or portion 50 constituted by a laser beam printer and a facsimile machine portion 60 for original reading and for communication or the like.

The facsimile machine station 60 is provided with a first controller 20 for controlling each means of the facsimile machine station 60, and to the first controller 20, an original reading portion 1, a MODEM controller 4, an operation panel 5, a sensor 8, a driving system 9, and memory 13 are connected.

The original reading portion 1 functions for the reading of the original to be sent and for converting it to image data. The image data is outputted to the MODEM controller 4 by the first controller 20, and is sent through a MODEM 3, which is a modulation/demodulation device and NCU2 which is a net controller, to the telephone line, while being controlled by the MODEM controller 4. The data received by it is supplied to the first controller 20 through the NCU2, MODEM 3, MODEM controller 4, and is once stored in the image memory 10, which will be described hereinafter, and therefore, is outputted to a recording station 50, which will be described hereinafter, by the first controller 20.

An operation panel 5 is provided with a display device 6 for displaying the state to the user, and keyboard 7 for the user to input various operations to the facsimile machine. The user operates the keyboard 7 in accordance with the message or the like on the display device 6 to send the data.

A sensor 8 detests states of the facsimile machine, and detects the setting of the original to be sent. When the first controller 20 discriminates the setting of the original by the sensor 8, a predetermined message is displayed on the display device 6 to promote the operation to the user. When the starting instruction for the sending operation is produced, the original is fed by a driving system 9 constituted by the reading motor or the like for feeding the original transportation, and the original is read, and the data are sent out.

The control program of the first controller for executing the above-described process, is stored in a ROM 12, of the memory 13. The memory 13 has an image memory 10 for storing the reception image data or the like and a system RAM 11 which is backed up by a battery or the like so that the data is not volatile even upon power supply stop.

The recording portion 50 has a second controller 40 for controlling the entire recording portion 50. To the second controller 40, a sensor 21, a driving system 22, a transfer portion 26, a scanner portion 27, a print portion 29, a fixing device 31, a fan motor drive portion 39, a heater controller 30, and a zero-cross point detection circuit 44 are connected.

The sensor 21 functions to detect the various states of the recording portion 50. It detects the presence or absence or the like of the recording material at a predetermined position in the recording portion 50, for example. Second controller 40 transports the recording paper to a predetermined position by a driving system 22, for example, on the basis of information from the sensor 21. This driving system 22 comprises a motor or the like 23 for effecting the recording paper transportation or the like, a plunger or the like 24 for controlling the driving of the motor or the like 23, and a clutch or the like 25 having a function similar to the plunger or the like 24.

The scanner portion 27 has a laser 28, and a latent image bearing member such as a photosensitive drum in the print portion 29 is scanned with the laser on the basis of image data produced from the facsimile machine portion 50 and the control signal from the second controller 40.

The print portion 29 is provided with a developing device in addition to the latent image bearing member. The electrostatic latent image is developed into a visualized image by the developing device. The second controller 40 drives the latent image bearing member and developing device to form the visualized image and thereafter drives the high voltage circuit b1 of the transfer portion 26, so as to transfer the developed image onto recording paper using the driving system 22.

The recording paper having the transfer image is transported to the heat fixing devise 31, wherein the heater 32 is actuated while detecting the temperature with thermistor 33, thus fixing the image on the recording paper by heat.

Figure 2:
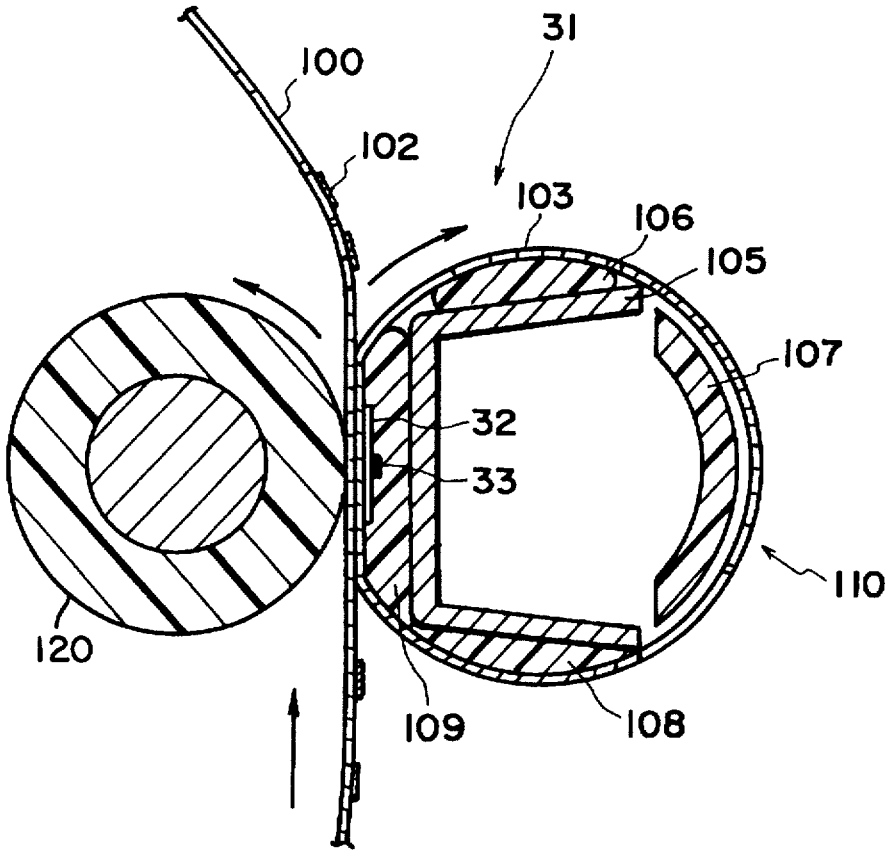
FIG. 2 is an illustration of a fixing device according to the first of embodiment of the present invention.

FIG. 2 shows a heat fixing device 31 used in the facsimile machine of FIG. 1. The fixing device 31 is an on-demand fixing device, and as shown in FIG. 2, it comprises a fixing member 110 having a heater 32, and a pressing roller 120 which forms a nip with the heater 32.

The fixing member 110 has a stay 105 having a channel-like section. Around the outer periphery portion of the stay 105, there are inside guide members 106, 107, 108 for guiding the inside of the film and a heater supporting member 109. The stay 105, the inside guide member 106, 107, 108 and the heater maintaining member 109 cooperate to form a generally cylindrical member, around which a thin film film 103 of polyimide having a thickness of several tens μm is wound. The inside surface of the film 103 is coated with grease, and the outer surface thereof has a Teflon coating.

Between the film 103 and the heater maintaining member 109, there is disposed the heater 32 contacting the inside surface of the film 103. The heater 32 has a linear heat generating resistor, a ceramic base plate for positing the heat generating resistor, and a thermistor 33 contacted thereto.

In order to effect a satisfactory fixing in such fixing device, it is desirable to maintain the temperature of the heater 32 at a predetermined value. In this embodiment, the temperature is controlled by controlling the AC voltage applied to the heater 32 by the heater controller 30 having a TRIAC or the like as shown in FIG. 1.

The temperature control is such that a reversion timing of the polarity in the AC voltage source is detected by a zero-cross point detection circuit 44, and in response to the timing, the conduction angle of the AC voltage source applied to the heater is changed.

By driving the heater 32 in this manner, the temperature in the apparatus increases, and therefore, the fan motor portion 39 is driven by a fan motor driver 39 to cool the inside of the apparatus.

The transfer portion 26 supplied with the high voltage and the fixing device 31 having a high temperature by the supply of the AC voltage source should not be contacted by the user. Therefore, when a door switch 43 detects the opening of the portions of the transfer portion 26 and the fixing device 31, the AC voltage source is shut off to protect the user.

To the recording portion 50 and the facsimile machine portion 60, a DC voltage source 42 for converting the energy of the AC voltage source into DC voltage is connected. The AC power supplied from the AC input portion 45 can be supplied through a AC voltage source ON/OFF switch 41 operable by the user.

This AC voltage source functions as the energy source for the DC voltage source 42, and in addition, the energy is applied to the heater 32 while the predetermined control is effected through the heater controller 30. Therefore, normally temperature control is not possible if the ON/OFF of the switch is repeated by tampering of the switch by children, or when very long interruption occurs due to the improper contact with the electrical outlet or due to the trouble with the electric power equipment upstream of the electrical outlet.

Therefore, in the device of this embodiment, the use is made with the zero-cross point detection circuit 44 used for the phase control of the heater so that the abnormality of the AC voltage source is detected on the basis of the presence or absence of zero-cross by the zero-cross point detection circuit 44. The detailed description will be made as to the zero-cross point detection circuit 44 in this embodiment.

Figure 3:
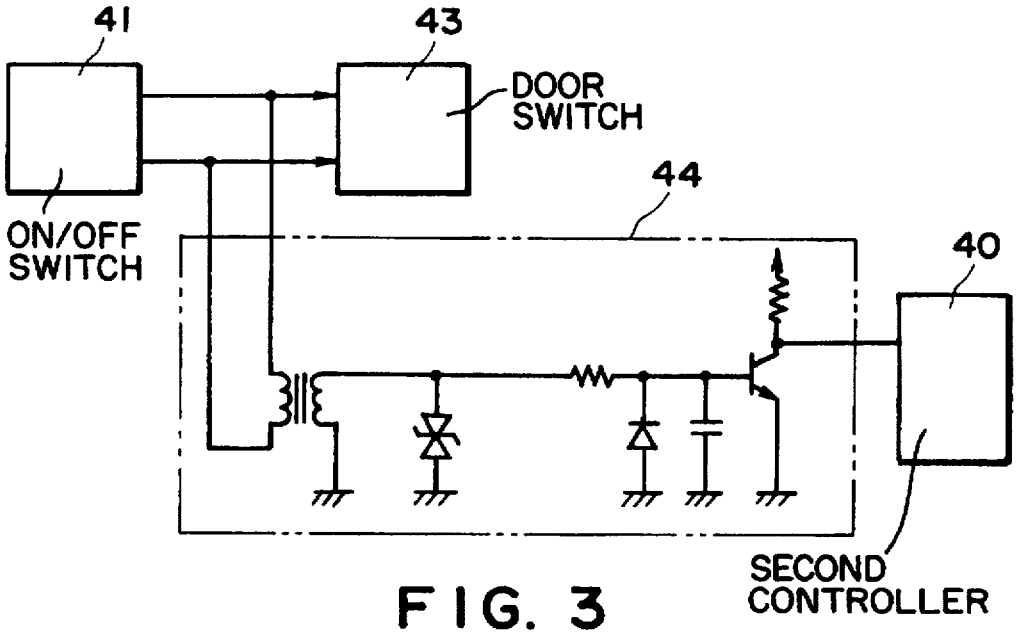
FIG. 3 illustrates an example of a circuit structure of a zero-cross point detection circuit portion according to the first embodiment of the present invention.

FIG. 3 shows an example of a zero-cross point detection circuit 44. In this circuit, from the voltage source supply line to the door switch 43 from the AC voltage source ON/OFF switch 41, the AC voltage source is taken out separately from the secondary side circuit from the transformer, and the transistor is rendered on and off in response to the change of the polarity of the AC voltage thus taken out, and it is supplied to the second controller 40. The zero-cross occurs at the rising and the falling, and the second controller can detect the zero-cross. The phase control of the heater is effected in accordance with this timing.

However, when the abnormality occurs in the AC voltage source due to the defect contact or the like of the electrical outlet or the malfunction of the voltage source switch 41 as described above, the period in which no zero-cross occurs is longer than usual, and therefore, by detecting the period, the abnormality of the AC voltage source can be detected.

Figure 4:
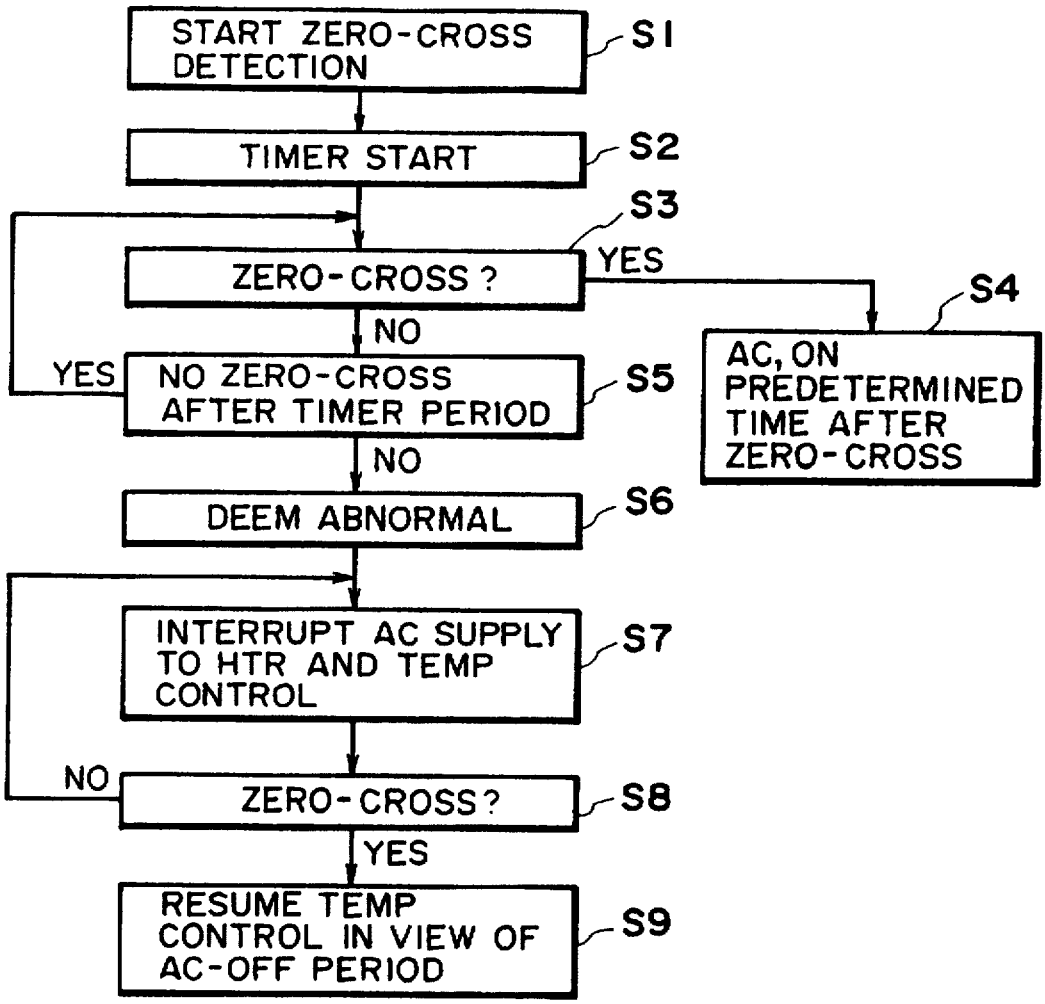
FIG. 4 is a flow chart of a heater control according to the first embodiment.

FIG. 4 is a flow chart for the abnormality detection for the AC voltage source. The detection of the zero-cross point by the zero-cross point detection circuit 44 is started (step S1), and the timer is started (step S2). The discrimination is made as to whether the zero-cross occurs or not (step S3). If so, the predetermined control of the heater is affected (step S4). However, if the zero-cross does not occur even after the time period (first predetermined time period) is longer than a predetermined time (step S5), it is deemed that the interruption of the AC voltage source occurred (step S6), and the energization control for the heater is interrupted (step S7). When the zero-cross occurs thereafter (step S8), the heater control, is effected in consideration of the power interruption period of the heater. For example, when the power interruption time is shorter than a second predetermined period, the normal heater control is effected, after the resetting. If the power interruption time is longer than the second predetermined period and the power interruption occurs frequently, the heater breakdown control is effected ( step S9).

As described in the foregoing, according to the present invention, the power interruption of the AC voltage source can be detected, and therefore, the heater control upon the AC voltage source abnormality for the heater can be optimized, thus preventing the breakdown of the heater substantially without adding parts to the conventional system structure.

Figure 5:
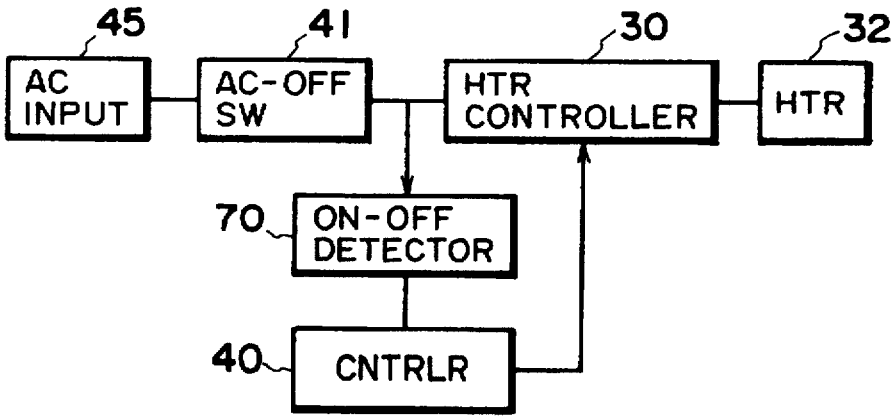
FIG. 5 is a block diagram around the heater controller according to a second embodiment of the present invention.

Referring to FIG. 5, the second embodiment will be described. The same reference numerals as in the first embodiment are assigned to the elements having the corresponding functions, and detailed descriptions thereof are omitted for simplicity.

In this embodiment, in order to detect the ON/OFF-state of a AC voltage source ON/OFF switch 41, an ON-OFF detector 70 is provided and is connected to the second controller 40.

By monitoring the output of the ON-OFF detection means 70, the second controller 40 can detect the abnormality operation of the AC voltage source ON/OFF switch 41. When the abnormality operation is discriminated, the heater controller 30 is operated, so that the energization to the heater 32 is stopped. When the reset is discriminated, the energization and control for the heater 32 are started in consideration of the interruption period.

According to the present invention, the abnormality operation of the voltage source switch is assuredly detected, and the heater control upon the AC voltage source abnormality can be optimized, and therefore, the breakdown of the heater can be prevented.

Figure 6:
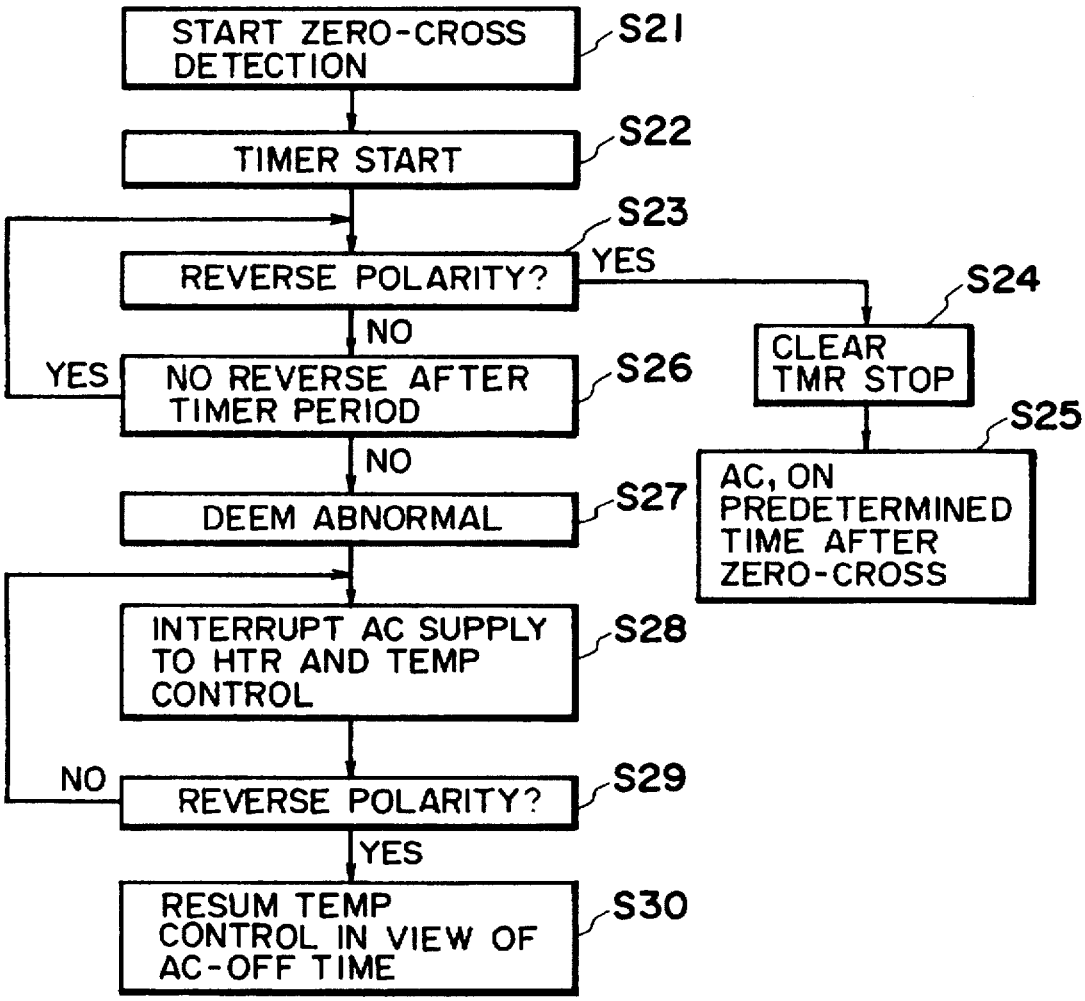
FIG. 6 is a flow chart of a heater control according to a third embodiment of the present invention.

Referring to FIG. 6, a third embodiment of the present invention will be described. The same reference numerals as in the first embodiment are assigned to the elements having the corresponding functions, and detailed descriptions thereof are omitted for simplicity.

In this embodiment, the detection of the zero-cross point is effected by detecting the level at the input port. This is different from the first embodiment.

FIG. 6 is a flow chart for the abnormality detection for this embodiment. The detection of the zero-cross point is started by a zero-cross point detection circuit 44 (step S21), and the timer is started (step S22). By detecting the level at the input port, the discrimination is made as to the reversion of the polarity of the AC voltage source (step S23). If there is, the timer is stopped and cleared (step S24), and the predetermined control for the heater is carried out ( step S25). However, if the reversion of the polarity does not occur even if the period exceeds a predetermined level (step S26), it is discriminated that the interruption occurred in the AC voltage source (step S27), and the energization control to the heater is interrupted (step S28). When the reversion of the polarity occurs thereafter (step S29), the energization to the heater is interrupted, the heater control is carried out in consideration of the power supply interruption period (step S30).

Figure 7:
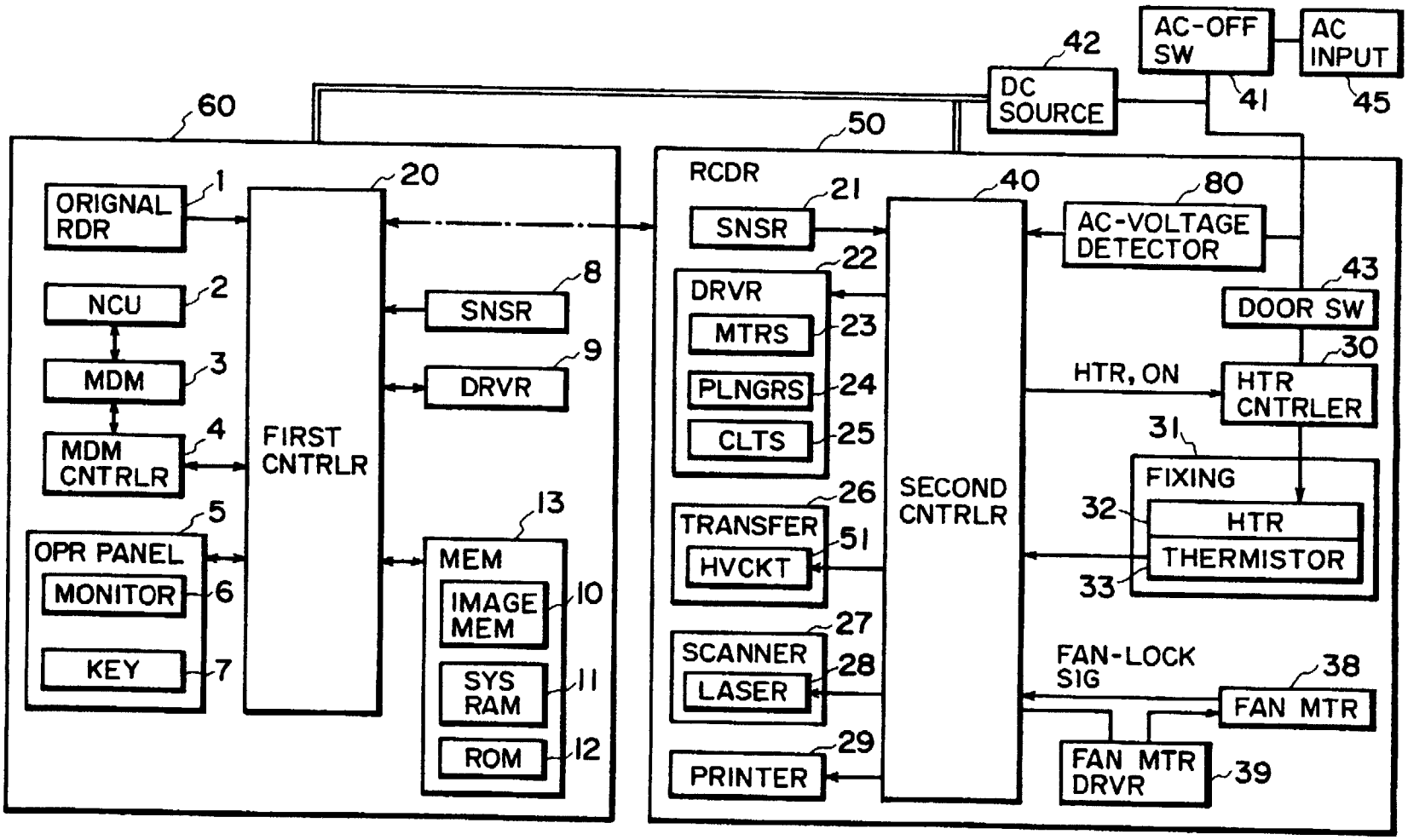
FIG. 7 is a block diagram of a facsimile machine device according to a fourth embodiment of the present invention.
Figure 8:
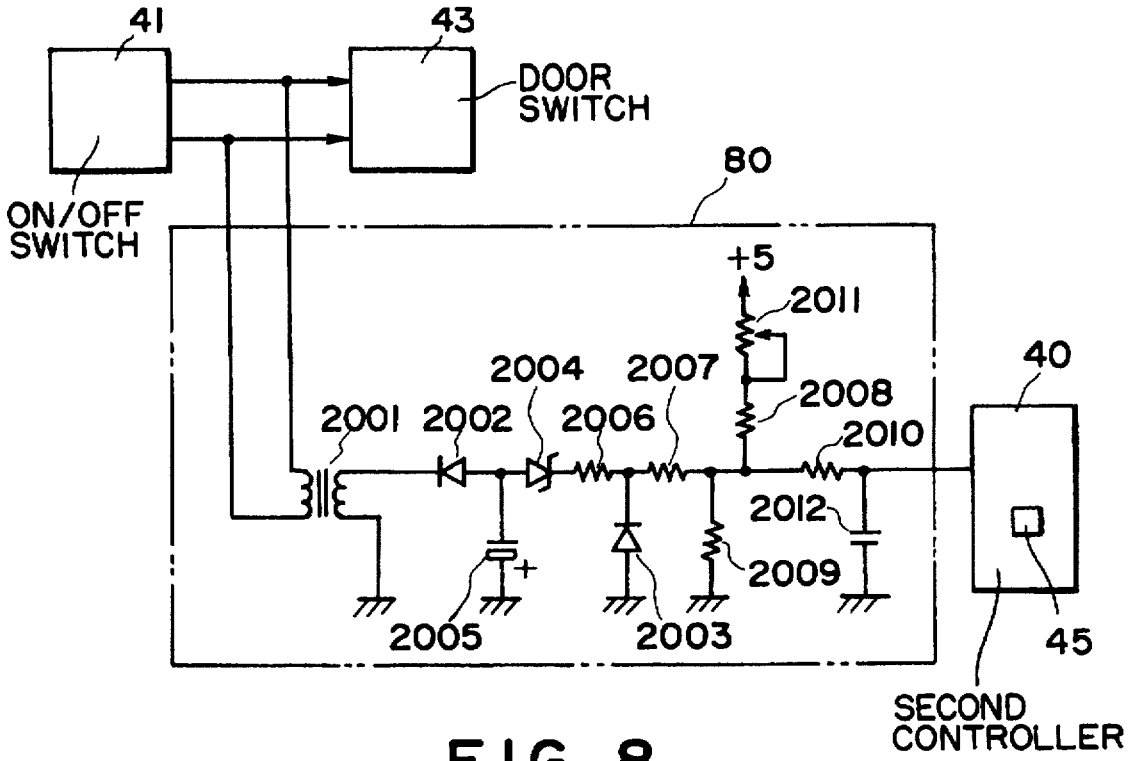
FIG. 8 is an example of a circuit structure of an AC voltage voltage detection circuit portion according to a fourth embodiment of the present invention.
Figure 9:
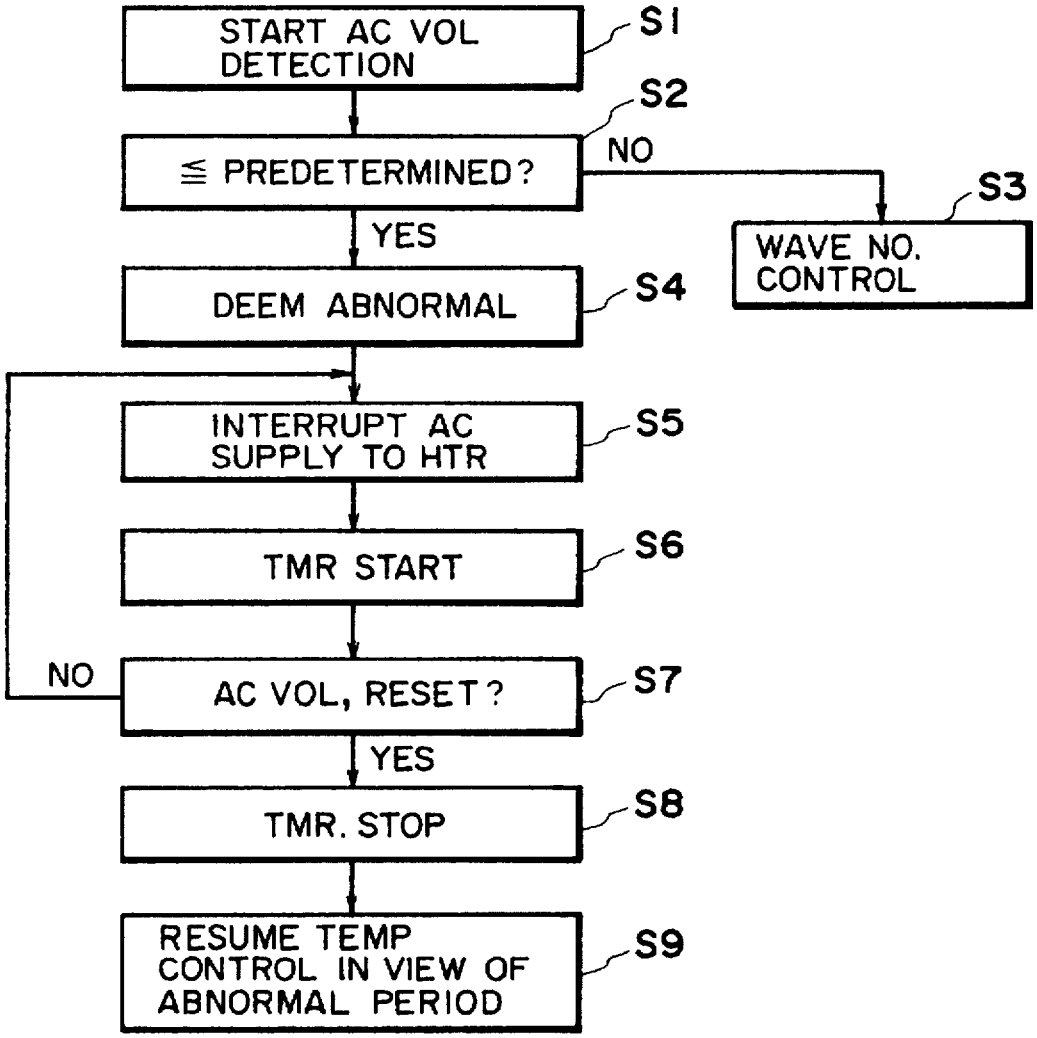
FIG. 9 is a flow chart of a heater control according to a fourth embodiment of the present invention.

Referring to FIGS. 7–9 the fourth embodiment of the present invention will be described. The same reference numerals as in the first embodiment are assigned to the elements having the corresponding functions, and detailed descriptions thereof are omitted for simplicity.

In order to effect the satisfactory fixing in the fixing device as shown in FIG. 2, it is desired that the temperature of the heater 32 is maintained at a predetermined level, and therefore, in this embodiment, the AC voltage applied to the heater 32 is controlled by a heater controller 30 comprising a TRIAC to control the temperature.

In this temperature control, a fine tolerance for the AC power source voltage value or the fine variation thereof is detected, and the wave number of the AC voltage source for the heater is changed in response to it.

To accomplish this, the use is made with the AC voltage detection circuit 80 for the wave number control for the heater to detect the abnormality of the AC voltage Source on the basis of of the AC voltage from the AC voltage detection circuit 80. The AC voltage detection circuit 80 will be described in detail.

FIG. 8 shows an example of an AC voltage detection circuit 80. In this circuit, from the voltage source supply line to the door switch 43 from the AC voltage source ON OFF switch 41, the AC voltage source is taken out of the secondary side circuit, and the voltage 100 V is lowered to 12 V to facilitate the detection of the AC voltage by the semiconductor circuit. The AC voltage thus taken out of the transformer 2001 is converted to a DC voltage and supplied to the second controller 40 through a diode 2002, an electrolytic capacitor 2005, a Zenor diode 2004, resistors 2006, 2007, 2008, 2009, 2010, 2011, a diode 2003, and a capacitor 2012. With the decrease of the voltage of the AC 100 V voltage source, it reaches 5 V. For example, when the AC voltage is 100 V, it is 2.5 V, and when the AC voltage is 85 V, it is 3.4 V. The second controller 40 A/C-converts the DC voltage value so that the fine change of the AC power source voltage value can be detected.

Even when the interruption or temporary voltage decrease occurs in the AC voltage source, the second controller 40 can detect the decrease of the voltage value, thus permitting detection of the abnormality of the AC voltage source.

In this circuit, the AC voltage is converted to the DC voltage. The AC voltage value can be detected, irrespective of the timing of the AC voltage detection of the second controller 40.

FIG. 9 is a flow chart for the abnormality detection of the AC voltage source in this embodiment. The AC voltage detection circuit 80 detects the voltage value of the AC voltage source (step S1). The description will be made as to whether the voltage value is lower than a constant value or not (step S2). If it is higher, the subsequent process (wave no control) is carried out (step S3). However , if it is lower, the abnormality of the AC voltage source is discriminated (step S4), and the energization to the heater is interrupted (step S5), and the timer is started (step S6). The description will be made as to whether the AC voltage source is properly restored or not (step S7). When it is restored, the timer is stopped (step S8). The heater control, in consideration of the interruption time, is effected. For example, if the interruption time is short, the normal control is carried out after the restoration. If the interruption time is long, and the interruption occurs frequently, the operation is shifted to the heater breakdown control (step S9).

Figure 10:
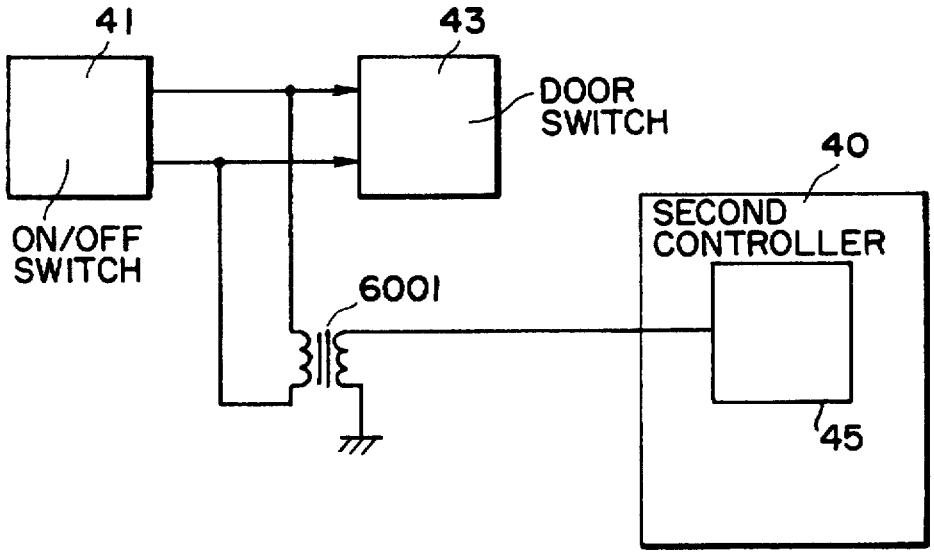
FIG. 10 shows an AC voltage detection circuit diagram according to a fifth embodiment of the present invention.

Referring to FIG. 10, the description will be made as to a fifth embodiment of the present invention. The same reference numerals as in the first embodiment are assigned to the elements having corresponding functions, and detailed descriptions thereof are omitted for simplicity.

This embodiment is a modification of the AC voltage detection circuit shown in FIG. 8. In this embodiment, the AC power source voltage is not converted to the DC, but it is received by an A/D conversion device 45 built in the second controller 40. In this case, second controller 40 has to detect the voltage value cumbersomely, but the responsiveness is quicker than in the foregoing embodiment in the discrimination of the AC voltage value with a simpler circuit.

While the invention has been described with reference to the structures disclosed herein, it is not confined to the details set forth and this application is intended to cover such modifications or changes as may come within the purpose of the improvements or the scope of the following claims.

What is claimed is:

1. A heating and fixing device comprising:

a heater for generating heat upon electric power supply thereto;

a zero-cross detection means for detecting a zero-cross point of AC power supplied to said heater;

electric power supply control means for controlling the electric power supply to said heater in an electric power supply control operation, wherein said electric power supply control means phase-controls the electric power supply to said heater in cooperation with said zero-cross detection means; and a timer for measuring time after detection of the zero-cross point by said zero-cross detection means, wherein when said zero-cross detection means detects the zero-cross point within a first predetermined time period after actuation of said timer, said control means continues the electric power supply control operation, when said zero-cross detection means detects the zero-cross point for a period longer than the first predetermined time period within a second predetermined time period, said control means interrupts and then resumes the electric power supply control operation, and when the zero-cross point is not detected even after elapse of the second predetermined time period, an abnormality removing operation is effected.

2. An apparatus according to claim 1, wherein the electric power supply is shut off upon detection of the abnormality.

* * * * *

UNITED STATES PATENT AND TRADEMARK OFFICE

CERTIFICATE OF CORRECTION

PATENT NO. : 5,802,421

DATED : September 1, 1998

INVENTOR : SHIGEO MIURA

It is certified that error appears in the above-identified patent and that said Letters Patent is hereby corrected as shown below:

On the title page

FPD, "4090563" and "4282588" should read --4-090563--, and --4-282588--, respectively.

COLUMN 1,
Line 17, "t" should read --the--.

COLUMN 3,
Line 5, "NCU2" should read --NCU 2--;
Line 8, "NCU 2" should read --NCU 2,--;
Line 17, "detests" should read --detects--; and
Line 62, "b1" should read --51--.

COLUMN 4,
Line 15, "film film" should read --film--; and
Line 50, "a" should read --an--.

UNITED STATES PATENT AND TRADEMARK OFFICE

CERTIFICATE OF CORRECTION

PATENT NO. : 5,802,421

DATED : September 1, 1998

INVENTOR : SHIGEO MIURA

It is certified that error appears in the above-identified patent and that said Letters Patent is hereby corrected as shown below:

COLUMN 6,
Line 43, "of of" should read --of--.

COLUMN 7,
Line 10, "(wave no" should be deleted; and
Line 11, "control)" should be deleted.

Signed and Sealed this

Eleventh Day of May, 1999

*Attest:*

*Attesting Officer*

Q. TODD DICKINSON

*Acting Commissioner of Patents and Trademarks*